US010415111B2

(12) United States Patent
Tada et al.

(10) Patent No.: US 10,415,111 B2
(45) Date of Patent: Sep. 17, 2019

(54) HIGH-STRENGTH STEEL SHEET FOR CONTAINERS AND METHOD FOR PRODUCING THE SAME

(71) Applicant: JFE STEEL CORPORATION, Tokyo (JP)

(72) Inventors: Masaki Tada, Chiba (JP); Hayato Saito, Fukuyama (JP); Katsumi Kojima, Fukuyama (JP); Hiroki Nakamaru, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 194 days.

(21) Appl. No.: 15/307,620

(22) PCT Filed: Apr. 23, 2015

(86) PCT No.: PCT/JP2015/002215

§ 371 (c)(1),
(2) Date: Oct. 28, 2016

(87) PCT Pub. No.: WO2015/166653

PCT Pub. Date: Nov. 5, 2015

(65) Prior Publication Data

US 2017/0051376 A1 Feb. 23, 2017

(30) Foreign Application Priority Data

Apr. 30, 2014 (JP) ..... 2014-094027

(51) Int. Cl.

| | |
|---|---|
| ***C21D 9/46*** | (2006.01) |
| ***C22C 38/06*** | (2006.01) |
| ***C22C 38/02*** | (2006.01) |
| ***C22C 38/04*** | (2006.01) |
| ***C21D 8/02*** | (2006.01) |
| ***B21B 1/22*** | (2006.01) |
| ***C22C 38/00*** | (2006.01) |

(52) U.S. Cl.

CPC ..... *C21D 9/46* (2013.01); *B21B 1/22* (2013.01); *C21D 8/0226* (2013.01); *C21D 8/0236* (2013.01); *C21D 8/0263* (2013.01); *C21D 8/0268* (2013.01); *C22C 38/00* (2013.01); *C22C 38/001* (2013.01); *C22C 38/002* (2013.01); *C22C 38/004* (2013.01); *C22C 38/02* (2013.01); *C22C 38/04* (2013.01); *C22C 38/06* (2013.01); *B21B 2001/221* (2013.01); *B21B 2001/225* (2013.01)

(58) Field of Classification Search

CPC ..... B21B 1/22; B21B 2001/221; B21B 2001/225; C21D 8/0226; C21D 8/0236; C21D 8/0263; C21D 8/0268; C21D 9/46; C22C 38/00; C22C 38/001; C22C 38/002; C22C 38/004; C22C 38/02; C22C 38/04; C22C 38/06

See application file for complete search history.

(56) References Cited

U.S. PATENT DOCUMENTS

| | | | | |
|---|---|---|---|---|
| 6,334,910 | B1 | 1/2002 | Sato et al. | |
| 2002/0070653 | A1* | 6/2002 | Kodama | C21D 8/0236 313/402 |
| 2005/0279432 | A1* | 12/2005 | Takeuchi | C22C 38/06 148/603 |
| 2011/0076177 | A1 | 3/2011 | Aratani et al. | |
| 2011/0168303 | A1 | 7/2011 | Kato et al. | |
| 2013/0017116 | A1* | 1/2013 | Hatano | C21D 6/002 420/36 |
| 2013/0248060 | A1* | 9/2013 | Maruyama | C21D 9/46 148/645 |
| 2015/0121981 | A1* | 5/2015 | Vervaet | B21B 45/0242 72/41 |

FOREIGN PATENT DOCUMENTS

| | | | |
|---|---|---|---|
| CA | 2818682 | A1 | 6/2012 |
| CN | 103270183 | A | 8/2013 |
| CN | 103409706 | A | 11/2013 |
| EP | 2050834 | A1 | 4/2009 |
| EP | 2634282 | A1 | 9/2013 |
| JP | H08325670 | A | 12/1996 |
| JP | H10237549 | A | 9/1998 |

(Continued)

OTHER PUBLICATIONS

Canadian Office Action for Canadian Application No. 2,944,403, dated Nov. 1, 2017, 4 pages.

First Australian Examination Report for Australian Application No. 2015254790, dated Apr. 21, 2017, 2 pages.

Extended European Search Report for European Application No. 15785975.2, dated May 2, 2017—8 Pages.

Japanese Notice of Allowance with partial English language translation for Application No. JP 2015-543607, dated Nov. 17, 2015, 4 pages.

Chinese Office Action with partial English language translation for Application No. 201580022409.6, 8 pages, dated Aug. 25, 2017.

(Continued)

*Primary Examiner* — Ngoc-Yen Nguyen

(74) *Attorney, Agent, or Firm* — RatnerPrestia

(57) ABSTRACT

Provided are a high-strength steel sheet for containers and a method for producing the high-strength steel sheet. The high-strength steel sheet for containers has a composition containing, by mass, C: 0.0010% to 0.10%, Si: 0.04% or less, Mn: 0.10% to 0.80%, P: 0.007% to 0.100%, S: 0.10% or less, Al: 0.001% to 0.100%, N: 0.0010% to 0.0250%, and the balance being Fe and inevitable impurities. The difference between the dislocation density at the uppermost layer of the high-strength steel sheet in the thickness direction and the dislocation density at a depth of ¼ of the thickness of the high-strength steel sheet from the surface is $1.94\times10^{14}$ $m^{-2}$ or less. The high-strength steel sheet has a tensile strength of 400 MPa or more and a fracture elongation of 10% or more.

2 Claims, No Drawings

(56) References Cited

FOREIGN PATENT DOCUMENTS

| | | | | |
|---|---|---|---|---|
| JP | H11279688 | A | 10/1999 | |
| JP | 2001107186 | A | 4/2001 | |
| JP | 2009263788 | | 11/2009 | |
| JP | 2009263789 | | 11/2009 | |
| JP | 2013019027 | | 1/2013 | |
| JP | 2013133483 | | 7/2013 | |
| JP | 2013147744 | A | 8/2013 | |
| WO | 9963124 | A1 | 12/1999 | |
| WO | 2008018531 | | 2/2008 | |
| WO | 2013008457 | A1 | 1/2013 | |
| WO | WO-2013037760 | A1 * | 3/2013 | ..... B21B 45/0242 |

OTHER PUBLICATIONS

International Search Report and Written Opinion for International Application No. PCT/JP2015/002215, dated Aug. 4, 2015, 5 pages.

* cited by examiner

HIGH-STRENGTH STEEL SHEET FOR CONTAINERS AND METHOD FOR PRODUCING THE SAME

CROSS REFERENCE TO RELATED APPLICATIONS

This application is the U.S. National Phase application of PCT International Application No. PCT/JP2015/002215, filed Apr. 23, 2015, and claims priority to Japanese Patent Application No. 2014-094027, filed Apr. 30, 2014, the disclosures of these applications being incorporated herein by reference in their entireties for all purposes.

FIELD OF THE INVENTION

The present invention relates to a high-strength steel sheet for containers and a method for producing the high-strength steel sheet.

BACKGROUND OF THE INVENTION

A specific type of steel sheets which are referred to as "DR (double reduced) steel sheets" may be used in the production of lids and bottoms of beverage cans and food cans, bodies of three-piece cans, drawn cans, and the like. DR steel sheets are produced by performing cold rolling, annealing, and again cold rolling. The thickness of DR steel sheets can be readily reduced compared with SR (single reduced) steel sheets, which are produced by performing only temper rolling subsequent to the cold-rolling and annealing steps.

One of the ways to reduce the cost of producing cans is to reduce the weights of members constituting the cans. For example, it is possible to reduce the weights of can lids by reducing, for example, the thickness of a material of the can lids. Thus, reducing the thickness of a steel sheet used in the production of can lids by using DR sheets or the like makes it possible to reduce the cost of producing cans.

While reducing the thickness of a steel sheet used in the production of can lids and the like makes it possible to reduce the cost of producing cans, it is necessary to prevent the strength of the can lids and the like from decreasing. Thus, it is necessary not only to reduce the thickness of the steel sheet but also to increase the strength of the steel sheet. For example, in the case where thin DR sheets are used, the DR sheets are required to have a tensile strength of about 400 MPa or more in order to produce cans having a certain strength. However, high-strength steel sheets having a smaller thickness than steel sheets that have been used in the related art are likely not capable of withstanding works. Specifically, a can is produced by performing blanking, a shell forming, and a curl forming (curling) in this order by press forming in order to form a lid, and subsequently seaming the flange portion of a can body with the curled portion of the lid in order to seal the can. In the curl forming, which is performed in the periphery of the lid, is likely to cause wrinkling to occur. Therefore, thin high-strength sheets have low formability despite their sufficiently high strength.

In the case where lids are produced from thin, high-strength sheets, buckling may occur in the circumferential direction when a diameter-reduction work is performed as a curl forming in order to reduce the diameter of the lid to be smaller than the diameter of the blank. In order to reduce the occurrence of buckling, in some cases, the curl forming is performed using, for example, inner and outer molds. However, introducing a new curl-work facility requires a large amount of capital investment.

In the production of DR sheets, cold rolling is performed subsequent to annealing. This causes work hardening. Thus, DR sheets are thin, hard steel sheets. DR sheets have poorer ductility and poorer workability than SR sheets. Therefore, in most cases, using the DR sheets requires the improvement of the workability of the DR sheets.

In addition to sanitary ends, there has been a widespread use of EOE (easy open end) cans that can be opened without a can opener. In the production of EOE cans, it is necessary to form a rivet, to which a tab is attached, by bulging and drawing. This work requires a certain degree of ductility of a material which corresponds to an elongation of about 10% in a tensile test.

Although it is difficult to achieve the certain degrees of ductility and strength described above by using DR sheets that have been used in the related art, there has been a growing demand for the application of DR sheets to the production of EOE cans and beverage cans from the viewpoint of a reduction in the cost of producing cans.

Patent Literature 1 discloses a technique in which the solute N content (Ntotal-NasAlN) in a steel sheet containing, by mass, C: 0.02% to 0.06%, Si: 0.03% or less, Mn: 0.05% to 0.5%, P: 0.02% or less, S: 0.02% or less, Al: 0.02% to 0.10%, N: 0.008% to 0.015%, and the balance being Fe and inevitable impurities is limited to be 0.006% or more, the total elongation of the steel sheet subjected to an aging treatment is limited to be 10% or more in the rolling direction and 5% or more in the width direction, and the average Lankford value of the steel sheet subjected to the aging treatment is limited to be 1.0 or less.

Patent Literature 2 discloses a technique in which the solute N content in a steel sheet containing, by mass, C: more than 0.02% and 0.10% or less, Si: 0.10% or less, Mn: 1.5% or less, P: 0.20% or less, S: 0.20% or less, Al: 0.10% or less, N: 0.0120% to 0.0250%, solute N: 0.0100% or more, and the balance being Fe and inevitable impurities is limited to be a predetermined value or more, and the steel sheet is hardened by quench aging and strain aging performed in a printing step, a film-laminating step, a drying-baking step, or the like that are conducted before the steel sheet is formed into cans in order to increase the strength of the steel sheet. Patent Literature 2 also discloses a method for producing a steel sheet in which hot rolling is performed such that the slab-extraction temperature is 1200° C. or more and the finishing-rolling temperature is (Ar3 transformation temperature—30°) C. or more and the resulting hot-rolled sheet is coiled at 650° C. or less.

CITATION LIST

Patent Literature

PTL 1: WO2008/018531

PTL 2: Japanese Unexamined Patent Application Publication No. 2009-263788

SUMMARY OF THE INVENTION

The descriptions in Patent Literature 1 and Patent Literature 2 have the following issues.

Although the DR sheet disclosed in Patent Literature 1 has an average Lankford value of 1.0 or less, it is necessary to increase the Lankford value of the DR sheet for achieving high formability. If the average Lankford value of a steel sheet is 1.0 or less, it is difficult to achieve high formability required by steel sheets for cans. Moreover, in the technique described in Patent Literature 1, the fracture elongation of the DR sheet is not at a sufficient level.

In the method described in Patent Literature 2, in order to increase the absolute amount of solute N to be a predetermined value, it is necessary to set the slab-extraction temperature in the hot-rolling step to be 1200° C. or more such that AlN is remelted. However, if the slab-extraction temperature is set to 1200° C. or more, the occurrence of scale defect may be increased due to the high temperature.

Aspects of the present invention are made in light of the foregoing issues. An object of aspects of the present invention is to provide a high-strength steel sheet for containers which is suitably used as a material of can lids and particularly suitably used as a material of EOE cans and a method for producing the high-strength steel sheet.

The inventors of the present invention made extensive studies in order to address the above-described issues and found that, in order to enhance the ductility of a high-strength sheet, it is necessary to limit the difference between the dislocation density at the uppermost layer of the steel sheet in the thickness direction and the dislocation density at a depth of ¼ of the thickness of the steel sheet from the surface to be $1.94\times10^{14}$ $m^{-2}$ or less. The reason for which the formability of the steel sheet is enhanced when the difference in dislocation density falls within the predetermined range is not clear. This is presumably because, in the case where the difference in dislocation density is large, the steel sheet deforms nonuniformly when being worked and a difference in stress distribution occurs. This results in nonuniformity in the shape of the steel sheet after being formed and the occurrence of necking, which increases the risk of fracture and cracking. Aspects of the present invention are made on the basis of the foregoing findings. A summary of aspects of the present invention is described below.

(1) A high-strength steel sheet for containers, the high-strength steel sheet having a composition containing, by mass, C: 0.0010% to 0.10%, Si: 0.04% or less, Mn: 0.10% to 0.80%, P: 0.007% to 0.100%, S: 0.10% or less, Al: 0.001% to 0.100%, N: 0.0010% to 0.0250%, and the balance being Fe and inevitable impurities, a difference between a dislocation density at an uppermost layer of the high-strength steel sheet in a thickness direction thereof and a dislocation density at a depth of ¼ of the thickness of the high-strength steel sheet from a surface thereof being $1.94\times10^{14}$ $m^{-2}$ or less, the high-strength steel sheet having a tensile strength of 400 MPa or more and a fracture elongation of 10% or more.

(2) A method for producing the high-strength steel sheet for containers described in (1), the method including a hot-rolling step of hot-rolling a heated slab and coiling the hot-rolled steel sheet at a temperature of less than 710° C.; a primary cold-rolling step of cold-rolling the hot-rolled steel sheet with a total primary cold-rolling reduction of more than 85%; an annealing step of annealing the cold-rolled sheet; and a secondary cold-rolling step of cold-rolling the annealed sheet with a facility including first and second stands, the first stand including a roll having a roughness Ra of 0.70 to 1.60 μm, the second stand including a roll having a roughness Ra of 0.20 to 0.69 μm, the secondary cold-rolling being performed using a lubricating liquid with a total reduction of 18% or less.

In the high-strength steel sheet for containers according to aspects of the present invention, the difference between the dislocation density at the uppermost layer of the steel sheet in the thickness direction and the dislocation density at a depth of ¼ of the thickness of the steel sheet from the surface is controlled to be $1.94\times10^{14}$ $m^{-2}$ or less. This makes it possible to achieve a tensile strength of 400 MPa or more and a fracture elongation of 10% or more. The high-strength steel sheet for containers having a high strength and high ductility has resistance to cracking that may occur in a riveting work performed in the production of EOE cans. Furthermore, since the difference in dislocation density is controlled to be $1.94\times10^{14}$ $m^{-2}$ or less, the curl workability of the high-strength steel sheet for containers is enhanced. As a result, the high-strength steel sheet for containers according to aspects of the present invention has resistance to wrinkling that may occur in the curl work. As described above, since the high-strength steel sheet for containers according to aspects of the present invention is a high-strength material having excellent rivet workability and excellent curl workability, it is particularly preferably used for producing can lids as a thin DR sheet and enables the thickness of can lids to be markedly reduced.

According to aspects of the present invention, controlling the difference in dislocation density to be $1.94\times10^{14}$ $m^{-2}$ or less makes it possible to achieve a high strength and high ductility. In accordance with aspects of the present invention, the occurrence of surface defects which may be caused by setting the slab-reheating temperature to be high, that is, 1200° C. or more, is reduced.

Since the high-strength steel sheet for containers according to aspects of the present invention is not composed of an aluminium alloy, a reduction in pressure resistance, which may occur when an aluminium alloy is used, does not occur.

DETAILED DESCRIPTION OF EMBODIMENTS OF THE INVENTION

An embodiment of the present invention is described below. The present invention is not limited to the embodiment below.

A high-strength steel sheet for containers according to aspects of the present invention (hereinafter, may be referred to as "steel sheet for can lids") has a specific composition. Furthermore, the difference between the dislocation density at the uppermost layer of the steel sheet in the thickness direction and the dislocation density at a depth of ¼ of the thickness of the steel sheet from the surface is controlled to be $1.94\times10^{14}$ $m^{-2}$ or less. This enables the high-strength steel sheet for containers according to aspects of the present invention to have a high strength and high ductility. The composition, the properties such as the difference in dislocation density, and the production method of the high-strength steel sheet for containers according to aspects of the present invention are described below in this order.

<Composition>

The high-strength steel sheet for containers according to aspects of the present invention has a composition containing, by mass, C: 0.0010% to 0.10%, Si: 0.04% or less, Mn: 0.10% to 0.80%, P: 0.007% to 0.100%, S: 0.10% or less, Al: 0.001% to 0.100%, N: 0.0010% to 0.0250%, and the balance being Fe and inevitable impurities. In the following description of constituents, "%" refers to "% by mass".

C: 0.0010% to 0.10%

The steel sheet for can lids according to aspects of the present invention has a sufficiently large fracture elongation since a secondary cold-rolling reduction has been controlled in the production of the steel sheet. The steel sheet for can lids according to aspects of the present invention also has a high strength since the C content is high. If the C content is less than 0.0010%, it is not possible to achieve the required tensile strength of 400 MPa. If the required tensile strength is not achieved, it is difficult to achieve a significant economic impact by reducing the thickness of the steel sheet for can lids. Accordingly, the C content is limited to be 0.0010% or more. However, a C content exceeding 0.10% increases the hardness of the steel sheet for can lids to an excessive degree at which it is difficult to produce a steel sheet having appropriate workability (ductility) even by controlling the secondary cold-rolling reduction. Accordingly, the upper limit of the C content is set to 0.10%.

Si: 0.04% or Less

If the Si content in the steel sheet for can lids according to aspects of the present invention exceeds 0.04%, for example, surface treatment property may be reduced and the corrosion resistance of the steel sheet may be degraded. Accordingly, the upper limit of the Si content is set to 0.04%. However, reducing the Si content to be less than 0.003% requires a large amount of refining cost. Thus, the Si content is preferably set to 0.003% or more.

Mn: 0.10% to 0.80%

Mn limits the likelihood of hot shortness being caused due to S during hot rolling and reduces the size of crystal grains. Therefore, Mn is an element necessary for achieving the desired properties of the steel sheet. In order to achieve the predetermined strength by using the steel sheet for can lids having a reduced thickness, the strength of the material needs to be increased. The Mn content needs to be 0.10% or more in order to increase the strength of the material. However, an excessively large Mn content deteriorates the corrosion resistance of the steel sheet and increases the hardness of the steel sheet to an excessive degree. Accordingly, the upper limit of the Mn content is set to 0.80%.

P: 0.007% to 0.100%

P is a hazardous element that increases the hardness of steel and deteriorates the workability and corrosion resistance of the steel sheet for can lids. Therefore, the upper limit of the P content is set to 0.100%. However, reducing the P content to be less than 0.007% requires a large amount of dephosphorization cost. Accordingly, the lower limit of the P content is set to 0.007%.

S: 0.10% or Less

S is a hazardous element that is present in steel in the form of an inclusion and deteriorates the ductility and corrosion resistance of the steel sheet. In order to reduce the above negative impacts, the upper limit of the S content is set to 0.10%. However, reducing S content to be less than 0.001% requires a large amount of desulfurization cost. Accordingly, the S content is preferably set to 0.001% or more.

Al: 0.001% to 0.100%

Al is a necessary element that serves as a deoxidizer in steel-making. A low Al content may result in insufficiency of deoxidation, which increases the amount of inclusion and deteriorates the workability of the steel sheet for can lids. It is considered that deoxidation is performed to a sufficient degree when the Al content is 0.001% or more. However, an Al content exceeding 0.100% increases the likelihood of surface defects being caused due to alumina clusters and the like. Accordingly, the Al content is limited to be 0.001% or more and 0.100% or less.

N: 0.0010% to 0.0250%

A high N content deteriorates the hot ductility of the steel sheet and causes the slab to be cracked during continuous casting. In order to reduce the above negative impacts, the upper limit of the N content is set to 0.0250%. However, if the N content is less than 0.0010%, the required tensile strength of 400 MPa or more may fail to be achieved. Thus, the N content is limited to be 0.0010% or more.

The balance of the composition of the steel sheet according to aspects of the present invention, which is other than the above-described essential constituents, includes Fe and inevitable impurities.

<Properties>

Difference in Dislocation Density

One of the features of the steel sheet for can lids according to aspects of the present invention is that the dislocation densities at the upper and lower surfaces of the steel sheet are high and, although the dislocation density at the inside of the steel sheet is lower than those at the surfaces of the steel sheet, the difference in dislocation density between the inside of the steel sheet and the surfaces of the steel sheet is small. Specifically, the difference between the dislocation density at the uppermost layer of the steel sheet in the thickness direction and the dislocation density at a depth of ¼ of the thickness of the steel sheet from the surface is $1.94\times10^{14}$ $m^{-2}$ or less.

The steel sheet for cans is likely to be subjected to a particularly large force such as a large bending force when being formed into can sides or can lids. For example, a strong tensile or compressive force is applied to the surface-side portion of the steel sheet when the steel sheet is bent. Therefore, if the surface-side portion of the steel sheet is hard, it is difficult to work the steel sheet into can lids or the like. When the difference in dislocation density is $1.94\times10^{14}$ $m^{-2}$ or less as in accordance with aspects of the present invention, the workability of the steel sheet may be enhanced. Aspects of the present invention were made by finding the relationship between the difference in dislocation density and the workability of the steel sheet.

The dislocation densities at the uppermost layer in the thickness direction and the dislocation densities at a depth of ¼ of the thickness of the steel sheet are not limited but preferably each fall within the range of $10^{14}$ to $10^{16}$ $m^{-2}$ so as to satisfy the difference in dislocation density. It is preferable to set the dislocation densities at the uppermost layer in the thickness direction and the dislocation densities at a depth of ¼ of the thickness of the steel sheet to $10^{14}$ to $10^{16}$ $m^{-2}$ from the viewpoint of the consistency of production.

This is because increasing the rolling load of a rolling machine in order to increase dislocation density places a heavy load on the rolling machine and reducing the rolling load of a rolling machine in order to reduce dislocation density causes the roll to slip on the steel sheet and makes it difficult to roll the steel sheet.

Dislocation density can be determined by the Williamson-Hall method. Specifically, the half-bandwidths of the diffraction peaks corresponding to the (110), (211), and (220) planes are measured at a depth of ¼ of the thickness of the steel sheet. After making correction by using the half-bandwidths of an undistorted Si specimen, strain ε is determined. Then, dislocation density ($m^{-2}$) is evaluated by $\rho=14.4\varepsilon^2/(0.25\times10^{-9})^2$.

When the difference in dislocation density is controlled to be within the above-described range, the steel sheet has a surface roughness Ra of 0.20 μm or more, a PPI of 100 or less, and a glossiness of 63 or less.

When the surface roughness Ra of the steel sheet is 0.20 μm or more, the steel sheet has excellent appearance. The surface roughness Ra of the steel sheet is preferably 0.20 to 1.60 μm. This is because, if the surface roughness Ra of the steel sheet is smaller than 0.20 μm, operation flaws, which may be formed when the samples are rubbed against each other, become noticeable and, if the surface roughness Ra of the steel sheet is large, a nonuniform plating film is likely to be deposited on the steel sheet in the subsequent step and the appearance of the plated steel sheet may be degraded. The surface roughness Ra of the steel sheet is determined by the method described in Examples below.

If the PPI of the steel sheet exceeds 100, the surface of the steel sheet becomes whitish and the appearance of the steel sheet is likely to be degraded. Accordingly, the PPI of the steel sheet is preferably 100 or less. If the PPI of the steel sheet is smaller than 10, the metallic color of the steel sheet may become noticeable. Thus, the PPI of the steel sheet is preferably 10 or more and is more preferably 10 to 80. The PPI of the steel sheet is determined by the method described in Examples below.

If the glossiness of the steel sheet is larger than 63, the steel sheet is likely to have an appearance such that the steel sheet reflects light as a mirror does and the appearance of the steel sheet may be degraded. Accordingly, the glossiness of the steel sheet is preferably 63 or less. The glossiness of the steel sheet is further preferably 20 to 62 because, if the glossiness of the steel sheet is smaller than 20, the steel sheet is likely to have an appearance such that the surface of the steel sheet is clouded. The glossiness of the steel sheet is determined by the method described in Examples below.

The average Lankford value according to aspects of the present invention is preferably more than 1.0 and 2.0 or less in order to maintain the accuracy of the dimension of the products formed by works.

Average Crystal Grain Diameter

The crystal grains of the steel sheet for can lids according to aspects of the present invention are described below. In accordance with aspects of the present invention, the average diameter of crystal grains included in a cross section of the steel sheet which is parallel to the rolling direction is preferably 5 μm or more. The conditions of the crystal grains greatly affect the final mechanical properties (tensile strength and fracture elongation) of the steel sheet for can lids according to aspects of the present invention. If the average diameter of crystal grains included in a cross section of the steel sheet which is parallel to the rolling direction is less than 5 μm, the predetermined fracture elongation of the steel sheet may fail to be achieved and the workability of the steel sheet may be degraded. On the other hand, excessively large crystal grains may reduce the tensile strength of the steel sheet. Thus, the average diameter of crystal grains is preferably 7 μm or less and is further preferably 5.0 to 6.3 μm.

The average crystal grain diameter can be controlled by changing annealing conditions. For example, the average crystal grain diameter is likely to be increased when the soaking temperature in the annealing treatment is increased. The average crystal grain diameter is likely to be reduced when the soaking temperature in the annealing treatment is reduced.

Tensile Strength and Fracture Elongation

The mechanical properties of the steel sheet for can lids according to aspects of the present invention are described below. The steel sheet for can lids according to aspects of the present invention has a tensile strength of 400 MPa or more. If the tensile strength of the steel sheet is less than 400 MPa, it is not possible to reduce the thickness of the steel sheet to a level at which a remarkable economic impact is achieved while maintaining the strength of the steel sheet at a level required by can lids. Thus, the tensile strength of the steel sheet for can lids according to aspects of the present invention is limited to be 400 MPa or more.

The steel sheet for can lids according to aspects of the present invention has a fracture elongation of 10% or more. If a steel sheet having a fracture elongation of less than 10% is used for producing EOE cans, cracking may occur in the riveting work.

The tensile strength and fracture elongation of the steel sheet can be determined in accordance with a method of tensile test of metallic materials which is described in JIS Z 2241.

<Production Method>

A method for producing the steel sheet for can lids according to aspects of the present invention is described below. The steel sheet for can lids according to aspects of the present invention can be produced by, for example, a method including a hot-rolling step, a primary cold-rolling step, an annealing step, and a secondary cold-rolling step.

Normally, it is difficult to reduce the thickness of the steel sheet to a level at which a remarkable economic impact is achieved by conducting only a single cold-rolling step. In other words, reducing the thickness of the steel sheet to a sufficient degree by conducting a single cold-rolling step places an excessively large load on a rolling machine and may be difficult depending on the capacity of the facility.

It is possible to reduce the thickness of the cold-rolled steel sheet by rolling the steel sheet to a smaller thickness than normal in the hot-rolling step. However, if the rolling reduction in the hot-rolling step is increased, a reduction in the temperature of the steel sheet which occurs during the rolling step is increased. This makes it difficult to set a predetermined finishing temperature. Furthermore, if the thickness of the steel sheet that has not yet been subjected to an annealing treatment is reduced, in the case where continuous annealing is performed, the risk of breaking, deformation, and the like of the steel sheet occurring in the annealing treatment is increased. For the above reasons, in accordance with aspects of the present invention, a second cold-rolling step is conducted subsequent to the annealing step in order to produce a steel sheet having a markedly small thickness. The reasons for limiting preferable production conditions are described below.

Hot-Rolling Step

In the hot-rolling step, a heated slab is hot-rolled and subsequently coiled at less than 710° C.

If the temperature at which the hot-rolled sheet is coiled is 710° C. or more, a pearlite microstructure having a large grain size is formed and brittle fracture may occur at the pearlite microstructure. This reduces the local elongation of the steel sheet and makes it impossible to achieve a fracture elongation of 10% or more. If the coiling temperature is 710° C. or more, thick scales remain on the surface of the steel sheet. The scales remain even after pickling is performed in order to remove the scales. As a result, surface defects may occur. Accordingly, the temperature at which the hot-rolled sheet is coiled is set to be less than 710° C. and is more preferably set to 560° C. to 620° C.

Primary Cold-Rolling Step

The primary cold-rolling step is a step subsequent to the hot-rolling step described above, in which the hot-rolled sheet is cold-rolled such that the total primary cold-rolling reduction is more than 85%.

In accordance with aspects of the present invention, the primary cold-rolling step includes rolling the hot-rolled sheet through a plurality of stands. If the total primary cold-rolling reduction is small, it is necessary to increase the hot-rolling reduction and the secondary cold-rolling reduction for producing a steel sheet for can lids having a markedly small thickness as a final product. However, it is not preferable to increase the hot-rolling reduction for the above-described reasons, and the secondary cold-rolling reduction needs to be limited for the reasons described below. For the above reasons, setting the total primary cold-rolling reduction to 85% or less makes it difficult to produce the steel sheet for can lids according to aspects of the present invention. Accordingly, the total primary cold-rolling reduction is set to be more than 85% and is preferably set to 90% or more. The total primary cold-rolling reduction is preferably set to 92% or less.

Annealing Step

The annealing step is a step subsequent to the primary cold-rolling step, in which the cold-rolled sheet is annealed. It is necessary to complete recrystallization by performing annealing. The soaking temperature in the annealing step is preferably set to 600° C. to 750° C. from the viewpoints of the efficiency of operation and prevention of breaking of the thin steel sheet which may occur during the annealing step.

Secondary Cold-Rolling Step

The secondary cold-rolling step is a step subsequent to the annealing step, in which the annealed sheet is cold-rolled with a facility including first and second stands. The first stand includes a roll having a roughness Ra of 0.70 to 1.60 μm. The second stand includes a roll having a roughness Ra of 0.20 to 0.69 μm. The secondary cold-rolling step is conducted using a lubricating liquid such that the total reduction is 18% or less. The first and second stands may be each constituted by a plurality of substands as long as the total reduction falls within the predetermined range and the roughness of the roll falls within the predetermined range. In the case where a plurality of substands are used, at least one substand includes a roll having a Ra of 0.70 to 1.60 μm, which corresponds to the roughness of the roll of the first stand, and at least one substand includes a roll having a Ra of 0.20 to 0.69 μm, which corresponds to the roughness of the roll of the second stand.

Performing cold rolling with two rolls in the secondary cold-rolling step and controlling the roughness Ra of the roll of the first stand and the roughness Ra of the roll of the second stand enable the difference in dislocation density to be controlled.

The difference in dislocation density can be controlled by changing the roughness Ra of the roll of the first stand and the roughness Ra of the roll of the second stand in the secondary cold-rolling step. Controlling the roughness Ra of the roll of the first stand in the secondary cold-rolling step to be larger causes the dislocation density at the uppermost layer to be higher. Controlling the roughness Ra of the roll of the second stand to be smaller reduces the area of portions at which the roll and the steel sheet are brought into contact with each other. This makes it possible to control the dislocation density at a depth of ¼ of the thickness of the steel sheet. As described above, the dislocation density at the surface layer can be controlled by changing the roughness Ra of the roll of the first stand, and the dislocation density at a depth of ¼ of the thickness of the steel sheet can be controlled by changing the roughness Ra of the roll of the second stand. Thus, the difference in dislocation density can be controlled. The reductions at which the annealed sheet is cold-rolled through the first and second stands are not limited. It is preferable to achieve 80% to 95% of the total reduction required in the secondary cold-rolling step by using the first stand having a larger roughness and 5% to 20% of the total reduction by using the second stand having a smaller roughness.

In the secondary cold-rolling step, a lubricating liquid is used and the total reduction is set to 18% or less. Common lubricating liquids may be used. Using a lubricating liquid makes lubrication conditions uniform and enables rolling to be performed under a low-reduction condition such that the reduction is 18% or less without fluctuations in the thickness of the steel sheet. Setting the total reduction to 18% or less is necessary for achieving a high strength without reducing the fracture elongation of the steel sheet. The total reduction is preferably set to 15% or less and is more preferably set to 10% or less. The lower limit of the total reduction is not specified but preferably set to 1% or more. The rolling reduction is more preferably more than 5% in order to roll the steel sheet in a consistent manner without sliding of the steel sheet which may occur during rolling.

Thickness: 0.1 to 0.34 mm

In accordance with aspects of the present invention, the thickness of the steel sheet for can lids is not limited but preferably set to 0.1 to 0.34 mm by controlling the reductions in the hot-rolling step, the primary cold-rolling step, and the secondary cold-rolling step. If the thickness of the steel sheet is smaller than 0.1 mm, the amount of load placed on the cold-rolling step is increased and it may become difficult to perform rolling. If the thickness of the steel sheet is larger than 0.34 mm, the thickness of the steel sheet becomes excessively large and the advantage of the reduction in the weight of cans may be reduced. Thus, the thickness of the steel sheet for can lids is preferably 0.1 mm or more and is more preferably 0.30 mm or less.

Examples

Steels having the compositions described in Table 1 with the balance being Fe and inevitable impurities were each refined in an actual converter and formed into a steel slab by continuous casting. The steel slabs were reheated at 1230° C. and subsequently subjected to hot rolling and primary cold-rolling under the conditions described in Table 2. The finishing-rolling temperature in the hot-rolling step was set to 890° C. Pickling was performed subsequent to the primary cold-rolling step. Subsequent to the primary cold-rolling step, the resulting cold-rolled sheets were each subjected to continuous annealing at a soaking temperature of 670° C. for a soaking time of 20 seconds. Then, secondary cold rolling was performed under the conditions described in Table 2.

The roughness of the roll of the first stand and the roughness of the roll of the second stand were the surface roughness Ra of a steel sheet which is defined in JIS B 0601 and measured by the method defined in JIS B 0633.

On both surfaces of each of the resulting steel sheets, a Sn coating was applied continuously. Thus, plated steel sheets (tin plates) on which 2.8 g/m$^2$ of Sn was deposited per side were prepared. The tin plates were subjected to the following tests. Tables 2 and 3 summarize the test results.

Tensile Strength and Fracture Elongation

The tin plates were subjected to a heat treatment at 210° C. for 10 minutes which corresponded to a coating-baking process. The heat-treated tin plates were subjected to a tensile test. In the tensile test, the tensile strength (breaking strength) and the fracture elongation of each of the tin plates were measured using a JIS No. 5 tensile test specimen at a testing speed of 10 mm/min. Table 2 summarizes the results.

Average Lankford Value

The average Lankford value of each of the tin plates was evaluated in accordance with Appendix JA (Specification) "Natural Frequency Method" of JIS Z 2254 "Metallic materials-Sheet and strip-Determination of plastic strain ratio".

Average Crystal Grain Diameter

The average crystal grain diameter of each of the tin plates was determined by grinding a cross section of the steel sheet which was parallel to the rolling direction, performing initial etching so as to expose the grain boundaries, and applying a interception method using a linear testing line which is described in JIS G 0551.

Surface Roughness Ra of Steel Sheet

The surface roughness Ra of a steel sheet which is defined in JIS B 0601 was measured by the method defined in JIS B 0633. Table 2 summarizes the results.

PPI

Peak Per Inch (PPI) defined in JIS B 0601 was measured by the method defined in JIS B 0633. Table 2 summarizes the results.

Glossiness

The glossiness of each of the tin plates was measured by the method defined in JIS Z 8741. Table 2 summarizes the results.

Dislocation Density

The dislocation densities at the uppermost layer and the ¼ layer of each of the tin plates were determined in the following manner. Four planes, that is, Fe(110), (200), (211), and (220) planes were measured by XRD using Co as a radiation source in order to determine a half-bandwidth and a peak position. At the same time, a Si-single crystal sample having a known dislocation density was also measured. The dislocation density was determined by a comparison of half-bandwidth. Table 3 summarizes the results.

Evaluation of Pressure Resistance

The pressure resistance of each of the tin plates was measured in the following manner. A sample (the plated steel sheet) having a thickness of 0.21 mm was formed into a can lid having a diameter of 63 mm. The can lid was attached to a welded can side having a diameter of 63 mm by being seamed with the can side. Compressed air was introduced to the inside of the can, and the pressure at which the can lid was deformed was measured. An evaluation of "⊙" was given in the case where the can lid was not deformed even when the pressure inside the can reached 0.20 MPa. An evaluation of "○" was given in the case where the can lid was not deformed even when the pressure inside the can was increased to 0.19 MPa. An evaluation of "x" was given in the case where the can lid was deformed when the pressure inside the can was less than 0.19 MPa. Table 3 summarizes the results.

Evaluation of Formability

The formability of each of the tin plates was evaluated by subjecting the sample having a thickness of 0.21 mm to a testing machine specified in JIS B 7729 by the method specified in JIS Z 2247. An evaluation of "⊙" was given in the case where the Erichsen value (the height of the protrusion measured when through-cracking occurred) was 6.5 mm or more. An evaluation of "○" was given in the case where the Erichsen value was less than 6.5 mm and 6 mm or more. An evaluation of "x" was given in the case where the Erichsen value was less than 6 mm. Table 3 summarizes the results.

TABLE 1

| | Composition (mass %) | | | | | | | |
|---|---|---|---|---|---|---|---|---|
| No. | C | Si | Mn | P | S | Al | N | Remark |
| A | 0.0007 | 0.01 | 0.51 | 0.010 | 0.010 | 0.041 | 0.0170 | Comparative steel |
| B | 0.105 | 0.01 | 0.51 | 0.010 | 0.010 | 0.041 | 0.0170 | Comparative steel |
| C | 0.070 | 0.01 | 0.09 | 0.010 | 0.010 | 0.041 | 0.0170 | Comparative steel |
| D | 0.070 | 0.01 | 0.81 | 0.010 | 0.010 | 0.041 | 0.0170 | Comparative steel |
| E | 0.070 | 0.01 | 0.51 | 0.010 | 0.010 | 0.041 | 0.0270 | Comparative steel |
| F | 0.070 | 0.01 | 0.51 | 0.010 | 0.010 | 0.041 | 0.0195 | Invention steel |
| G | 0.070 | 0.01 | 0.51 | 0.010 | 0.010 | 0.041 | 0.0110 | Invention steel |
| H | 0.0012 | 0.01 | 0.51 | 0.010 | 0.010 | 0.041 | 0.0195 | Invention steel |
| I | 0.090 | 0.01 | 0.51 | 0.010 | 0.010 | 0.041 | 0.0195 | Invention steel |

TABLE 2

| No. | Steel type | Coiling temperature ° C. | Sheet thickness after hot rolling mm | Primary cold-rolling reduction % | Secondary cold-rolling reduction % | Sheet thickness after secondary cold rolling mm | Roughness of first stand roll μm | Roughness of second stand roll μm | First stand roll reduction % |
|---|---|---|---|---|---|---|---|---|---|
| 1 | A | 610 | 2.6 | 90 | 17 | 0.22 | 1.12 | 0.26 | 15.3 |
| 2 | B | 610 | 2.6 | 90 | 17 | 0.22 | 1.12 | 0.26 | 15.3 |
| 3 | C | 610 | 2.6 | 90 | 17 | 0.22 | 1.12 | 0.26 | 15.3 |
| 4 | D | 610 | 2.6 | 90 | 17 | 0.22 | 1.12 | 0.26 | 15.3 |
| 5 | E | 610 | 2.6 | 90 | 17 | 0.22 | 1.12 | 0.26 | 15.3 |
| 6 | F | 610 | 2.6 | 90 | 17 | 0.22 | 1.12 | 0.26 | 15.3 |
| 7 | F | 610 | 2.6 | 90 | 18 | 0.21 | 1.12 | 0.26 | 16.2 |
| 8 | F | 610 | 2.6 | 90 | 17 | 0.22 | 1.12 | 0.26 | 15.3 |
| 9 | F | 610 | 2.6 | 90 | 17 | 0.22 | 1.12 | 0.26 | 15.3 |
| 10 | F | 610 | 2.6 | 90 | 17 | 0.22 | 1.12 | 0.26 | 15.3 |
| 11 | F | 610 | 2.6 | 90 | 17 | 0.22 | 1.12 | 0.26 | 15.3 |
| 12 | F | 710 | 2.6 | 90 | 17 | 0.22 | 1.12 | 0.26 | 15.3 |
| 13 | F | 610 | 2.6 | 90 | 20 | 0.21 | 1.12 | 0.26 | 18.0 |
| 14 | F | 610 | 2.6 | 90 | 22 | 0.20 | 1.12 | 0.26 | 19.8 |
| 15 | G | 610 | 2.6 | 90 | 17 | 0.22 | 1.12 | 0.26 | 15.3 |
| 16 | F | 610 | 1.8 | 93 | 17 | 0.10 | 1.12 | 0.26 | 15.3 |
| 17 | F | 610 | 3.0 | 86 | 17 | 0.35 | 1.12 | 0.26 | 15.3 |

TABLE 2-continued

| | | | | | | | | | |
|---|---|---|---|---|---|---|---|---|---|
| 18 | F | 610 | 3.2 | 86 | 17 | 0.37 | 1.12 | 0.26 | 15.3 |
| 19 | F | 610 | 2.6 | 90 | 17 | 0.22 | 1.30 | 0.69 | 15.3 |
| 20 | F | 610 | 2.6 | 90 | 17 | 0.22 | 1.30 | 0.71 | 15.3 |
| 21 | F | 610 | 2.6 | 90 | 17 | 0.22 | 1.70 | 0.69 | 15.3 |
| 22 | H | 610 | 2.6 | 90 | 17 | 0.22 | 1.12 | 0.26 | 15.3 |
| 23 | I | 610 | 2.6 | 90 | 17 | 0.22 | 1.12 | 0.26 | 15.3 |
| 24 | F | 610 | 2.6 | 90 | 6 | 0.24 | 1.12 | 0.26 | 5.4 |
| 25 | F | 610 | 2.6 | 90 | 17 | 0.22 | 0.72 | 0.26 | 15.3 |
| 26 | F | 610 | 2.6 | 90 | 17 | 0.22 | 1.50 | 0.26 | 15.9 |

| No. | Second stand roll reduction % | Crystal grain diameter μm | Tensile strength MPa | Fracture elongation % | Average Lankford value | Steel sheet surface roughness Ra μm | PPI | Glossiness | Remark |
|---|---|---|---|---|---|---|---|---|---|
| 1 | 1.7 | 6.9 | 394 | 11 | 1.1 | 0.20 | 80 | 62 | Comparative example |
| 2 | 1.7 | 5.8 | 540 | 9 | 1.1 | 0.20 | 80 | 62 | Comparative example |
| 3 | 1.7 | 6.5 | 395 | 11 | 1.1 | 0.20 | 80 | 62 | Comparative example |
| 4 | 1.7 | 5.8 | 520 | 9 | 1.1 | 0.20 | 80 | 62 | Comparative example |
| 5 | 1.7 | 5.8 | 550 | 9 | 1.1 | 0.20 | 80 | 62 | Comparative example |
| 6 | 1.7 | 5.8 | 520 | 11 | 1.1 | 0.20 | 80 | 62 | Invention example |
| 7 | 1.8 | 5.8 | 520 | 12 | 1.1 | 0.20 | 80 | 62 | Invention example |
| 8 | 1.7 | 5.8 | 520 | 12 | 1.1 | 0.20 | 80 | 62 | Invention example |
| 9 | 1.7 | 5.9 | 520 | 12 | 1.1 | 0.20 | 80 | 62 | Invention example |
| 10 | 1.7 | 6.0 | 520 | 12 | 1.1 | 0.20 | 80 | 62 | Invention example |
| 11 | 1.7 | 5.6 | 540 | 11 | 1.1 | 0.20 | 80 | 62 | Invention example |
| 12 | 1.7 | 6.7 | 390 | 13 | 1.1 | 0.20 | 80 | 62 | Comparative example |
| 13 | 2.0 | 5.8 | 530 | 9 | 1.1 | 0.20 | 80 | 62 | Comparative example |
| 14 | 2.2 | 5.8 | 530 | 8 | 1.1 | 0.20 | 80 | 62 | Comparative example |
| 15 | 1.7 | 6.1 | 500 | 13 | 1.1 | 0.20 | 80 | 62 | Invention example |
| 16 | 1.7 | 5.8 | 520 | 12 | 1.1 | 0.20 | 80 | 62 | Invention example |
| 17 | 1.7 | 5.8 | 520 | 12 | 1.1 | 0.20 | 80 | 62 | Invention example |
| 18 | 1.7 | 5.8 | 520 | 12 | 1.1 | 0.20 | 80 | 62 | Invention example |
| 19 | 1.7 | 5.8 | 520 | 10 | 1.1 | 0.38 | 80 | 61 | Invention example |
| 20 | 1.7 | 5.8 | 530 | 9 | 0.9 | 0.40 | 82 | 60 | Comparative example |
| 21 | 1.7 | 5.8 | 532 | 9 | 0.9 | 0.39 | 81 | 60 | Comparative example |
| 22 | 1.7 | 6.8 | 402 | 14 | 1.1 | 0.20 | 80 | 62 | Invention example |
| 23 | 1.7 | 5.6 | 535 | 12 | 1.1 | 0.20 | 80 | 62 | Invention example |
| 24 | 0.6 | 5.8 | 450 | 15 | 1.1 | 0.20 | 80 | 62 | Invention example |
| 25 | 1.7 | 5.9 | 520 | 12 | 1.1 | 0.20 | 78 | 63 | Invention example |
| 26 | 1.7 | 5.8 | 520 | 11 | 1.1 | 0.29 | 81 | 60 | Invention example |

TABLE 3

| No. | Dislocation density ($m^{-2}$) Layer 1 (surface layer) | Layer 2 (1/4-depth) | Layer 1-Layer 2 | Pressure resistance | Formability | Remark |
|---|---|---|---|---|---|---|
| 1 | 1.0161E+15 | 8.7331E+14 | 1.43E+14 | X | ○ | Comparative example |
| 2 | 2.3730E+14 | 1.5882E+14 | 7.85E+13 | ○ | X | Comparative example |
| 3 | 1.0341E+15 | 1.0136E+15 | 2.04E+13 | X | ○ | Comparative example |
| 4 | 6.1587E+14 | 4.2153E+14 | 1.94E+14 | ○ | X | Comparative example |
| 5 | 9.1612E+14 | 8.7131E+14 | 4.48E+13 | ○ | X | Comparative example |
| 6 | 1.3730E+14 | 1.5683E+13 | 1.22E+14 | ◎ | ◎ | Invention example |
| 7 | 5.1587E+14 | 4.1953E+14 | 9.63E+13 | ○ | ○ | Invention example |
| 8 | 1.0161E+15 | 8.7331E+14 | 1.43E+14 | ○ | ◎ | Invention example |
| 9 | 2.3730E+14 | 1.5882E+14 | 7.85E+13 | ○ | ◎ | Invention example |
| 10 | 1.0341E+15 | 1.0136E+15 | 2.04E+13 | ○ | ◎ | Invention example |
| 11 | 6.1587E+14 | 4.2153E+14 | 1.94E+14 | ◎ | ○ | Invention example |
| 12 | 1.0061E+15 | 8.7311E+14 | 1.33E+14 | X | ○ | Comparative example |
| 13 | 1.0241E+15 | 1.0134E+15 | 1.06E+13 | ○ | X | Comparative example |
| 14 | 1.0151E+15 | 8.7329E+14 | 1.42E+14 | ○ | X | Comparative example |
| 15 | 1.0331E+15 | 1.0136E+15 | 1.95E+13 | ○ | ◎ | Invention example |
| 16 | 6.1487E+14 | 4.2151E+14 | 1.93E+14 | ○ | ◎ | Invention example |
| 17 | 1.0341E+15 | 1.0136E+15 | 2.04E+13 | ○ | ◎ | Invention example |
| 18 | 6.1587E+14 | 4.2153E+14 | 1.94E+14 | ○ | ◎ | Invention example |
| 19 | 6.1837E+14 | 4.2453E+14 | 1.94E+14 | ○ | ○ | Invention example |
| 20 | 6.2537E+14 | 4.2853E+14 | 1.97E+14 | X | X | Comparative example |
| 21 | 6.3537E+14 | 4.3903E+14 | 1.96E+14 | X | X | Comparative example |
| 22 | 1.0081E+15 | 8.7331E+14 | 1.35E+14 | ○ | ○ | Invention example |
| 23 | 6.1597E+14 | 4.2253E+14 | 1.93E+14 | ○ | ○ | Invention example |
| 24 | 2.0161E+14 | 9.8331E+13 | 1.03E+14 | ○ | ◎ | Invention example |
| 25 | 1.3760E+14 | 1.1882E+14 | 1.88E+13 | ○ | ○ | Invention example |
| 26 | 6.1517E+14 | 4.2603E+14 | 1.89E+14 | ○ | ○ | Invention example |

Note that, in the column "Dislocation density" in Table 3, the expression "E+XX" refers to "$\times 10^{XX}$". For example, in No. 1, the expression "1.43E+14" refers to "$1.43\times 10^{14}$".

The results described in Tables 1 to 3 confirm that Nos. 6 to 11, 15 to 19, and 22 to 26, which are invention examples, had an excellent tensile strength. Specifically, they achieved a tensile strength of 400 MPa or more (preferably 500 MPa or more), which is necessary for an ultrathin steel sheet for can lids. Nos. 6 to 11, 15 to 19, and 22 to 26 had excellent workability, that is, a fracture elongation of 10% or more, which is necessary for working the steel sheet into can lids.

No. 1, which is a comparative example, did not have the predetermined tensile strength because the C content was excessively low. No. 1 was also evaluated as poor in terms of pressure resistance.

No. 2, which is a comparative example, had an excessively high C content. Therefore, the ductility of the steel sheet was degraded by secondary cold-rolling and the fracture elongation of the steel sheet was degraded. No. 2 was also evaluated as poor in terms of formability.

No. 3, which is a comparative example, did not have the predetermined tensile strength because the Mn content was excessively low. No. 3 was also evaluated as poor in terms of pressure resistance.

No. 4, which is a comparative example, had an excessively high Mn content. Therefore, the ductility of the steel sheet was degraded by secondary cold-rolling and the fracture elongation of the steel sheet was degraded. No. 4 was also evaluated as poor in terms of formability.

No. 5, which is a comparative example, did not have the predetermined fracture elongation because the N content was excessively high. No. 5 was also evaluated as poor in terms of formability.

In No. 12, which is a comparative example, the coiling temperature was excessively high. As a result, the size of crystal grains was excessively large (i.e., the average crystal grain diameter (in a cross section perpendicular to the rolling direction) was large) and the predetermined tensile strength was not achieved. No. 12 was also evaluated as poor in terms of pressure resistance. No. 12, which is a comparative example, had an average crystal grain diameter of 6.7 μm.

In Nos. 13 and 14, which are comparative examples, the secondary cold-rolling reduction was excessively high. As a result, the ductility of the steel sheet was degraded by secondary cold-rolling and the predetermined fracture elongation was not achieved. Nos. 13 and 14 were also evaluated as poor in terms of formability.

In No. 20, which is a comparative example, the roughness of the roll of the second stand used in the secondary cold-rolling step was excessively large. In No. 21, which is a comparative example, the roughness of the roll of the first stand used in the secondary cold-rolling step was excessively large. As a result, in Nos. 20 and 21, the fracture elongation of the steel sheet was reduced and the pressure resistance and formability of the steel sheet were deteriorated. Nos. 20 and 21 had an average Lankford value slightly lower than those of invention examples.

The invention claimed is:

1. A high-strength steel sheet for containers, the high-strength steel sheet comprising a composition containing, by mass, C: 0.0010% to 0.10%, Si: 0.04% or less, Mn: 0.10% to 0.80%, P: 0.007% to 0.100%, S: 0.10% or less, Al: 0.001% to 0.100%, N: 0.0010% to 0.0250%, and the balance being Fe and inevitable impurities, a difference between a dislocation density at an uppermost surface of the high-strength steel sheet in a thickness direction thereof and a dislocation density at a depth of ¼ of the thickness of the high-strength steel sheet from the uppermost surface thereof being $1.94\times 10^{14}$ $m^{-2}$ or less, the high-strength steel sheet having a tensile strength of 400 MPa or more and a fracture elongation of 10% or more.

2. A method for producing the high-strength steel sheet for containers according to claim 1, the method comprising:

a hot-rolling step of hot-rolling a heated slab to form a hot-rolled steel sheet and coiling the hot-rolled steel sheet at a temperature of less than 710° C.;

a primary cold-rolling step of cold-rolling the hot-rolled steel sheet with a total primary cold-rolling reduction of more than 85%;

an annealing step of annealing the cold-rolled sheet; and a secondary cold-rolling step of cold-rolling the annealed sheet with a facility including first and second stands, the first stand including a roll having a roughness Ra of 0.70 to 1.60 μm, the second stand including a roll having a roughness Ra of 0.20 to 0.69 μm, the secondary cold-rolling being performed using a lubricating liquid with a total reduction of 18% or less.

* * * * *